United States Patent [19]

Lovejoy

[11] 4,324,633

[45] Apr. 13, 1982

[54] ELECTROLYTIC APPARATUS FOR TREATING CONTINUOUS STRIP MATERIAL

[76] Inventor: Curtis N. Lovejoy, 460 Matthew St., Bristol, Conn. 06010

[21] Appl. No.: 198,774

[22] Filed: Oct. 20, 1980

[51] Int. Cl.[3] ..... C25D 17/06

[52] U.S. Cl. ..... 204/206; 204/28

[58] Field of Search ..... 204/28, 206–211

[56] References Cited

U.S. PATENT DOCUMENTS

| | | | |
|---|---|---|---|
| 2,725,355 | 11/1955 | Gray | 204/208 |
| 2,930,739 | 3/1960 | Burnham | 204/28 |
| 2,953,507 | 9/1960 | Palme | 204/141 |
| 3,627,665 | 12/1971 | deLaminne | 204/209 |
| 3,803,014 | 9/1974 | Atkinson | 204/206 |

FOREIGN PATENT DOCUMENTS

| | | | |
|---|---|---|---|
| 540229 | 8/1955 | Belgium | 204/206 |
| 42-16530 | 9/1967 | Japan | 204/206 |
| 690916 | 4/1953 | United Kingdom | 204/28 |

*Primary Examiner*—F. Edmundson
*Attorney, Agent, or Firm*—McCormick, Paulding & Huber

[57] ABSTRACT

An electrolytic apparatus for treating continuous strip material comprises a tank defining a rinse chamber and a contact roller assembly which includes an idler roller and two driven electrical contact rollers supported by shafts for rotation about vertical axes to define a serpentine path for strip material passing through the chamber. Three sleeves project upwardly from the bottom wall of the tank to a position above the liquid level in the chamber and respectively receive the shafts therethrough. Each electrical contact roller has a diametrically enlarged annular flange at its upper end disposed externally of the chamber. A brush holder associated with each flange carries a plurality of carbon brushes which engage a radially disposed surface of the flange. Torque limiters are provided for limiting the torque which may be applied to the driven contact rollers.

10 Claims, 6 Drawing Figures

ELECTROLYTIC APPARATUS FOR TREATING CONTINUOUS STRIP MATERIAL

BACKGROUND OF THE INVENTION

This invention relates in general to electrolytic apparatus and deals more particularly with improvements in apparatus for electrolytic treatment of strip material. More specifically, the present invention is concerned with improvements in electroplating and anodizing apparatus used in the treatment of continuous strip material and with improvements in contact roller assemblies therefor.

In an apparatus of the aforedescribed general type wherein strip material is fed from a payoff reel to a takeup reel problems are often encountered in establishing and maintaining electrical contact with the strip material to be treated to avoid excessive power loss and/or damage to the material. It is the general aim of the present invention to provide an improved electrolytic apparatus which includes a roller contact assembly capable of carrying maximum anticipated currents to provide high current density with minimal power loss. A further aim of the invention is to provide an improved roller contact assembly which minimizes risk of damage to treated material and which is readily accessible for maintenance should and when such maintenance be required.

SUMMARY OF THE INVENTION

In accordance with the present invention an electrolytic apparatus for treating continuous strip material includes a roller contact assembly which comprises a plurality of rollers supported for rotation about parallel axes to define a serpentine path for strip material engaged by the rollers and passing therebetween. At least one of the rollers comprises an electrical contact roller which has an enlarged annular flange at one end thereof. At least one brush carried by a brush holder is biased into engagement with the enlarged annular flange on the contact roller.

DETAILED DESCRIPTION OF PREFERRED EMBODIMENT

Figure 1:
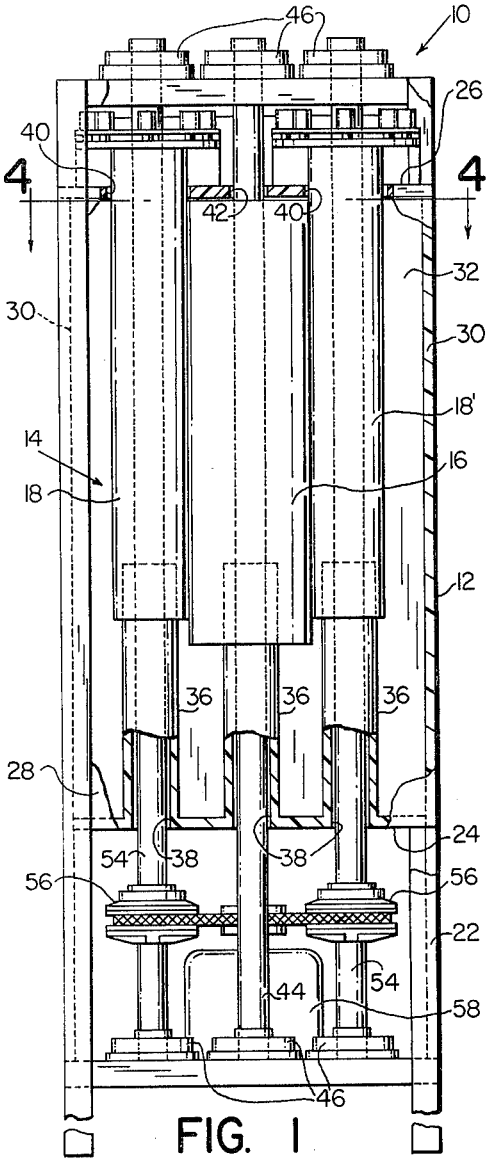
FIG. 1 is a fragmentary side elevational view of a portion of a continuous electroplating apparatus embodying the present invention.

Turning now to the drawing, a rinse tank assembly embodying the present invention and which comprises a part of a continuous strip electroplating apparatus is indicated generally by the reference numeral 10. The tank assembly 10 includes a rinse tank 12 and a contact roller assembly, designated generally by the numeral 14, which includes a plurality of rollers 16, 18 and 18' which cooperate to define a serpentine path of travel for a strip of material S being treated, as the strip is conveyed through the rinse tank 12. At least one of the rollers comprises an electrical contact roller which establishes electrical connection with the strip as it travels through the tank, as will be hereinafter discussed in further detail.

Figure 2:
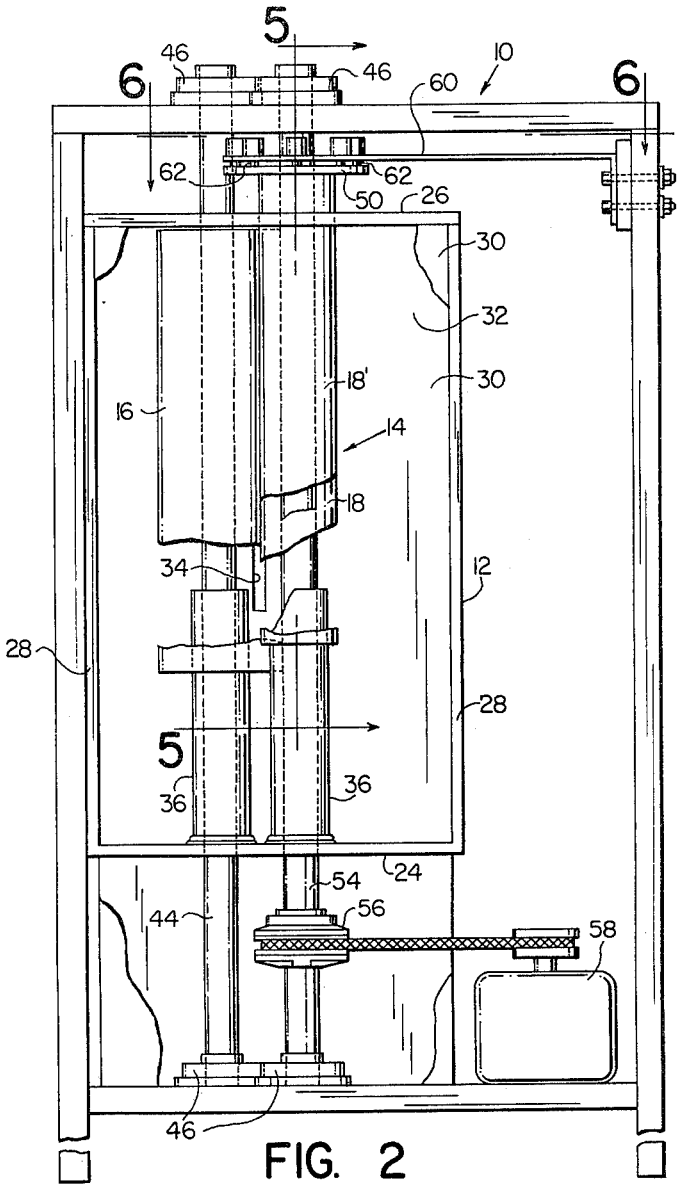
FIG. 2 is an end elevational view of the apparatus shown in FIG. 1.
Figure 6:
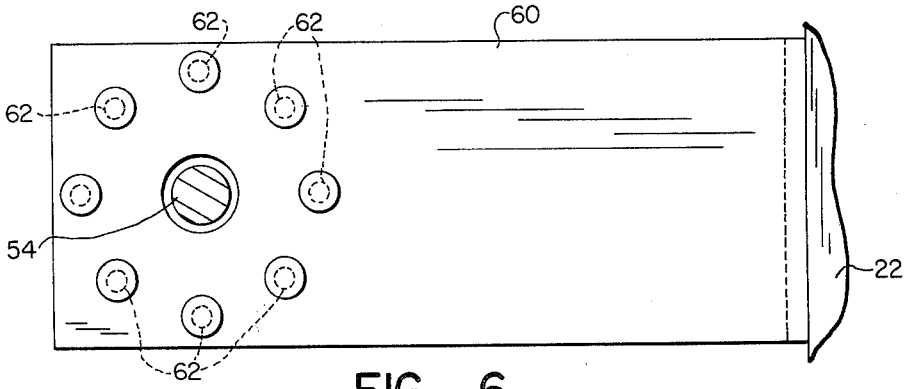
FIG. 6 is a somewhat enlarged fragmentary sectional view taken along the line 6—6 of FIG. 2.
Figure 3:
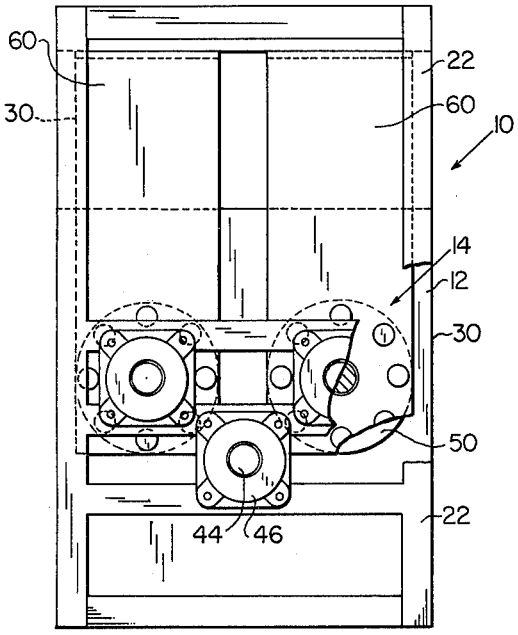
FIG. 3 is a plan view of the apparatus of FIGS. 1 and 2.
Figure 4:
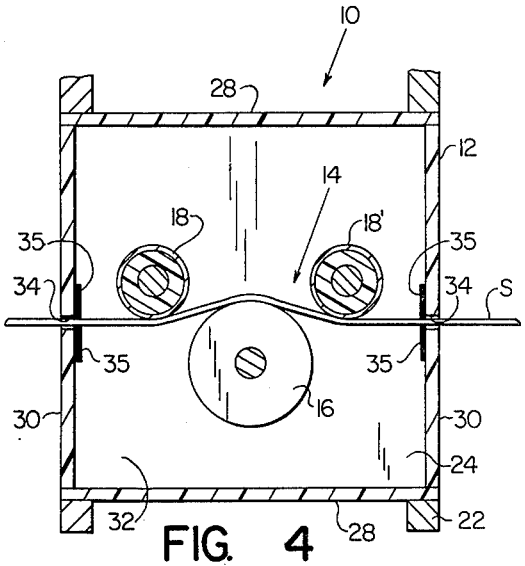
FIG. 4 is a fragmentary sectional view taken along the line 4—4 of FIG. 1.

Considering now the tank assembly 10 in further detail, the rinse tank 12 is generally rectangular and supported on and reinforced by a generally rectangular frame 22. The tank is preferably made from corrosion resistant dielectric material, such as polypropolene, and has a bottom wall 24, a top wall 26, side walls 28, 28 and end walls 30, 30 which define a generally rectangular rinse chamber 32. Vertically extending slots 34, 34, shown in FIGS. 2 and 4, are formed centrally of the end walls 30, 30 is generally tangential alignment with the rollers 18 and 18' to provide for entry of the strip S into and egress of the strip from the tank 12. Resilient elastomeric wiper strips 35, 35, are preferably provided at opposite sides of slots 34, 34, as shown in FIG. 4, and cooperate in sealing engagement with the strip S to prevent escape of liquid from the tank 12, as is well known in the art. Three axially upright generally cylindrical sleeves 36, 36 disposed within the chamber 32 are welded to the bottom wall 24 in surrounding relation to apertures 38, 38 formed in the bottom wall, substantially as shown. The upper ends of the sleeves 36, 36 are disposed at a level above the anticipated level of liquid contained within the chamber 32. Three generally cylindrical apertures 40, 40 and 42 are formed in the top wall 26. Each of the latter apertures is generally coaxially aligned with a respectively associated one of the sleeves 36, 36 for a purpose which will be hereinafter further evident. The tank 12 may be provided with a suitable drainage outlet (not shown) for controlling the level of liquid within the chamber 32.

The roller 16 comprises an idler roller wholly disposed within the chamber 32 and supported by an axially vertical idler shaft 44 which extends through the tank 12 in spaced relation to the walls thereof. More specifically, the shaft 44 extends through an aperture 38, an associated sleeve 36 and the aperture 42 and is supported at its upper and lower end by journals 46, 46 mounted on the frame 22 above and below the chamber 32, as best shown in FIGS. 1 and 2.

Figure 5:
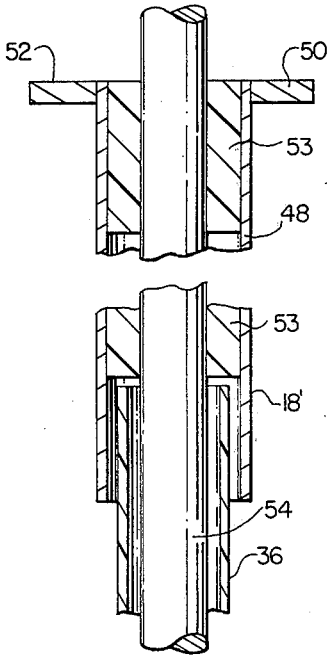
FIG. 5 is a somewhat enlarged sectional view of a contact roller taken along the line 5—5 of FIG. 2.

The contact rollers 18, and 18' are substantially identical. Referring now to FIG. 5, the illustrated contact roller 18' has a generally cylindrical tubular body portion 48 which is preferably made from an electrically conductive material, such as copper, to provide an electically conductve surface. A diametrically enlarged annular flange 50, which is made from an electrically conductive material, such as cooper, is brazed or otherwise secured to the upper end of the body portion 48 and has a generally radially disposed and upwardly facing contact surface 52. At least one bushing 53 made from a suitable dielectric material is disposed within the tubular body 48 and supports the body in coaxial relation to drive shaft 54 which has a torque limiter or friction clutch 56 mounted on it. The lower end portion of the body 48 has a depending skirt which surrounds the upper end portion of an associated sleeve 36. The upper and lower ends of the shaft 54 are supported by journals 46, 46 mounted on the frame 22 above and below the chamber 32, substantially as shown in FIGS. 1 and 2.

The contact rollers 18, 18' are mounted in fixed position on the shafts 54, 54 and are driven by a drive motor 58 mounted on the frame 22 and coupled to the torque limiters 56, 56 by a suitable belt or drive chain. Each contact roller has a brush holder 60 which is mounted on the frame 22 and insulated from it. Each brush holder 60 carries at least one brush 62 which is biased into electrical contact engagement with an associated contact surface 52. The illustrated brush holder 60 is preferably made from copper and carries eight equiangularly spaced carbon brushes 62, 62. The brush holders are connected in circuit with a rectifier which supplies electrical current to the apparatus. Each of the illustrated brushes is capable of carrying 150 ampers so that each brush holder has 1200 amp current capacity. One or more spray nozzles (not shown) are preferably mounted in the upper portion of the chamber for spraying water or a suitable rinse solution on the strip.

A strip S to be treated enters the chamber 32 through a slot 34 in an associated one of the end walls of the tank 12 in tangential alignment with one of the contact rollers 18, 18', passes between the rollers 16, 18 and 18' and leaves the chamber along a path of travel tangent to the other of the contact rollers and through the slot 34 in the other end wall of the housing. The rolls 16, 18 and 18' cooperate to define a serpentine path for the strip as it passes therebetween, as shown in FIG. 4. This arrangement causes substantial surface contact between the strip S and the peripheral surfaces of the contact rollers 18 and 18' for relatively high contact density. The brush holders which are located outside of the chamber utilize free floating brush contacts that are easily accessible for maintenance should and when it be required.

The vertical orientation of the strip or web helps prevent "creeping", a condition caused by one edge of the strip favoring a curled side, the curl having been formed by the action of the cutting blade shearing the strip from the original stock. The gravitational pull upon the vertically oriented strip prevents such "creeping". The torque limiters effectively prevent excessive torque at the contact roller which could mar strip finish through stretching or physically alter the temper of the strip.

The invention has been illustrated and described with reference to an apparatus particularly adapted for treating a vertically oriented strip of material, however, it should be understood that a contact roller assembly in accordance with the present invention may also be used in an apparatus for treating horizontally disposed strip material wherein the rollers which comprise the roller assembly are supported for rotation about parallel horizontal axes and such modified form of the apparatus are contemplated within the scope of the invention.

I claim:

1. An electrolytic apparatus for treating continuous strip material comprising a tank and a contact roller assembly including a plurality of generally cylindrical rollers, means supporting said rollers for rotation about parallel axes, each of said rollers being at least partially disposed within said tank, said rollers cooperating to define a serpentine path along which strip material is constrained to pass in traveling through said tank, at least one of said rollers comprising an electrical contact roller having an electrically conductive surface and a diametrically enlarged annular flange, said flange having a radially disposed contact surface, a brush holder supported in fixed position relative to said tank, and at least one brush carried by said brush holder and biased into electrically contacting engagement with said contact surface.

2. An electrolytic apparatus for treating continuous strip material as set forth in claim 1 wherein said tank has top, bottom and side walls defining a chamber and said annular flange and said brush holder are disposed externally of said chamber.

3. An electrolytic apparatus for treating continuous strip material as set forth in either claim 1 or claim 2 including means for driving at least one of said rollers.

4. An electrolytic apparatus for treating continuous strip material as set forth in claim 3 including means for limiting torque applied to the one driven roller by said driving means.

5. An electrolytic apparatus for treating continuous strip material as set forth in either claim 1 or claim 2 wherein said supporting means comprises a plurality of shafts and each of said shafts supports an associated one of said rollers and extends through said tank in spaced relation to the walls of said tank.

6. An electrolytic apparatus for treating continuous strip material as set forth in claim 5 wherein said tank has a plurality of tubular sleeves which extend into said tank from a wall thereof and each of said shafts extends through an associated one of said sleeves.

7. An electrolytic apparatus for treating continuous strip material as set forth in claim 6 wherein said shafts are vertically oriented and said sleeves project upwardly from the bottom wall of said tank.

8. An electrolytic apparatus for treating continuous strip material as set forth in claim 7 wherein each of said rollers has a depending skirt surrounding an upper end portion of an associated one of said sleeves.

9. In an electrolytic apparatus for treating strip material, a contact roller assembly comprising a plurality of generally cylindrical rollers, means supporting said rollers for rotation about parallel axes, said rollers cooperating to define a serpentine path for strip material which passes therebetween, at least one of said rollers comprising an electrical contact roller having an electrically conductive surface, said one roller having an enlarged annular flange including a radially disposed contact surface, a brush holder mounted in fixed position relative to said supporting means, and at least one brush carried by said brush holder and biased into electrically contacting engagement with said contact surface.

10. In an electrolytic apparatus for treating strip material as set forth in claim 9 the further improvement wherein said supporting means includes an axially elongated shaft and said one roller has a tubular body portion made from electrically conductive material and at least one dielectric bushing disposed within said tubular body portion and supporting said body portion in coaxial relation to said shaft.

* * * * *